US009232857B2

(12) United States Patent
Lai

(10) Patent No.: US 9,232,857 B2
(45) Date of Patent: Jan. 12, 2016

(54) MODULAR STORAGE FRAME

(71) Applicant: Jung Tan Lai, Dacun Township, Changhua County (TW)

(72) Inventor: Jung Tan Lai, Dacun Township, Changhua County (TW)

( * ) Notice: Subject to any disclaimer, the term of this patent is extended or adjusted under 35 U.S.C. 154(b) by 67 days.

(21) Appl. No.: 14/172,910

(22) Filed: Feb. 5, 2014

(65) Prior Publication Data

US 2015/0216299 A1 Aug. 6, 2015

(51) Int. Cl.
*A47B 43/00* (2006.01)
*A47B 87/02* (2006.01)

(52) U.S. Cl.
CPC ..... *A47B 87/0223* (2013.01)

(58) Field of Classification Search
CPC ..... A47B 87/0207; A47B 87/0215; A47B 87/0223; A47B 87/0246; A47B 2230/08; A47B 2230/15; A47B 7/042; A47B 57/7265
USPC ..... 211/194
See application file for complete search history.

(56) References Cited

U.S. PATENT DOCUMENTS

| | | | | | |
|---|---|---|---|---|---|
| 1,401,057 | A * | 12/1921 | Elliott | 108/101 |
| 1,431,823 | A * | 10/1922 | Leconte | 108/190 |
| 1,989,849 | A * | 2/1935 | Davies | 108/101 |
| 3,783,801 | A * | 1/1974 | Engman | 108/60 |
| 4,275,666 | A * | 6/1981 | Schriever | 108/101 |
| 4,760,800 | A * | 8/1988 | Hanson | 108/190 |
| 4,847,461 | A * | 7/1989 | Gilmore | 219/732 |
| 5,584,398 | A * | 12/1996 | Lin | 211/40 |
| 6,241,108 | B1 * | 6/2001 | Nakatani et al. | 211/187 |
| 6,247,414 | B1 * | 6/2001 | Sikora et al. | 108/190 |
| 6,902,074 | B2 * | 6/2005 | Albrecht | 211/189 |
| 8,499,944 | B2 * | 8/2013 | Parks et al. | 211/153 |
| 2008/0156759 | A1 * | 7/2008 | Lai | 211/187 |

* cited by examiner

*Primary Examiner* — Korie H Chan
(74) *Attorney, Agent, or Firm* — Leong C. Lei

(57) ABSTRACT

A modular storage frame includes: at least two storage floors each having four coupling heads, four coupling tubes, at least four opposing elements and a storage board, wherein the coupling head has two coupling portions, two neck portions and a joining portion; at least four joining tubes having four inner tubes and four outer tubes; and four supporting elements coupling respectively with the bottommost ones of the inner tubes, wherein the outer tube has two positioning elements protruding to an outside thereof. The positioning elements may provide the storage floors to be relatively firmly positioned. The opposing elements protruding from the coupling tubes may have the storage board to be easily placed and the plight that the opposing elements are not easily assembled with the coupling heads may be avoided.

12 Claims, 5 Drawing Sheets

MODULAR STORAGE FRAME

BACKGROUND OF THE DISCLOSURE a) Field of the Disclosure

The invention relates to a storage frame, and more particularly, to a modular storage frame.

b) Brief Description of the Related Art

A traditional modular storage frame is disclosed in the specification and figures issued in R.O.C. Pat. No. M312234. The modular storage frame includes a supporting element 22 arranged in an inner side of a frame sleeve 211, but this arrangement causes the assembly for the both to be difficult.

The modular storage frame includes a coupling tube 12 with radially reduced thicknesses at two ends thereof and with a smooth peripheral surface and thus the coupling tube 12 has no anti-slip and positioning function. Accordingly, the traditional modular storage frame has to be improved.

SUMMARY OF THE DISCLOSURE

The present invention provides a modular storage frame to enhance the engagement between a handle and a pressed element such that a detachment may be avoided. In order to achieve the above purpose, the present invention provides a modular storage frame including: at least two storage floors each having four coupling heads, four coupling tubes coupled respectively with the coupling heads so as to form an enclosed area, at least four opposing elements protruding respectively from the coupling tubes to the enclosed area, and a storage board arranged within the enclosed area and supported by the opposing elements, wherein the coupling head has two coupling portions at top and bottom sides thereof, two neck portions with cavities engaged with the coupling portions and a joining portion coupled between the neck portions; and at least four joining tubes having four inner tubes passing through the coupling heads respectively for positioning and four outer tubes coupling respectively with top sides of the coupling heads and having an end of the inner tubes protrude therefrom, wherein the outer tube has two positioning elements protruding to an outside thereof and contacting the coupling portions of the coupling heads.

The modular storage frame may further include four supporting elements coupling respectively with the bottommost ones of the inner tubes.

The modular storage frame may further include four decoration elements coupling respectively with the topmost ones of the inner tubes and coupling respectively with the topmost ones of the coupling heads.

The supporting elements may provide a function for adjusting a height.

The supporting elements may provide a function for moving around.

The supporting elements may provide a function for adjusting a height and/or moving around.

The storage board may be glass.

The storage board may be shaped like a sheet.

In accordance with the present invention, the positioning elements at the outside of the joining tubes may provide the storage floors to be relatively firmly positioned. The opposing elements protruding from the coupling tubes may have the storage board to be easily placed and the plight that the opposing elements are not easily assembled with the coupling heads may be avoided.

The accompanying drawings are included to provide a further understanding of the invention, and are incorporated as a part of this specification. The drawings illustrate embodiments of the invention and, together with the description, serve to explain the principles of the invention.

BRIEF DESCRIPTION OF THE DRAWINGS

The drawings disclose illustrative embodiments of the present disclosure. They do not set forth all embodiments. Other embodiments may be used in addition or instead. Details that may be apparent or unnecessary may be omitted to save space or for more effective illustration. Conversely, some embodiments may be practiced without all of the details that are disclosed. When the same numeral appears in different drawings, it refers to the same or like components or steps.

Aspects of the disclosure may be more fully understood from the following description when read together with the accompanying drawings, which are to be regarded as illustrative in nature, and not as limiting. The drawings are not necessarily to scale, emphasis instead being placed on the principles of the disclosure.

Figure 1:
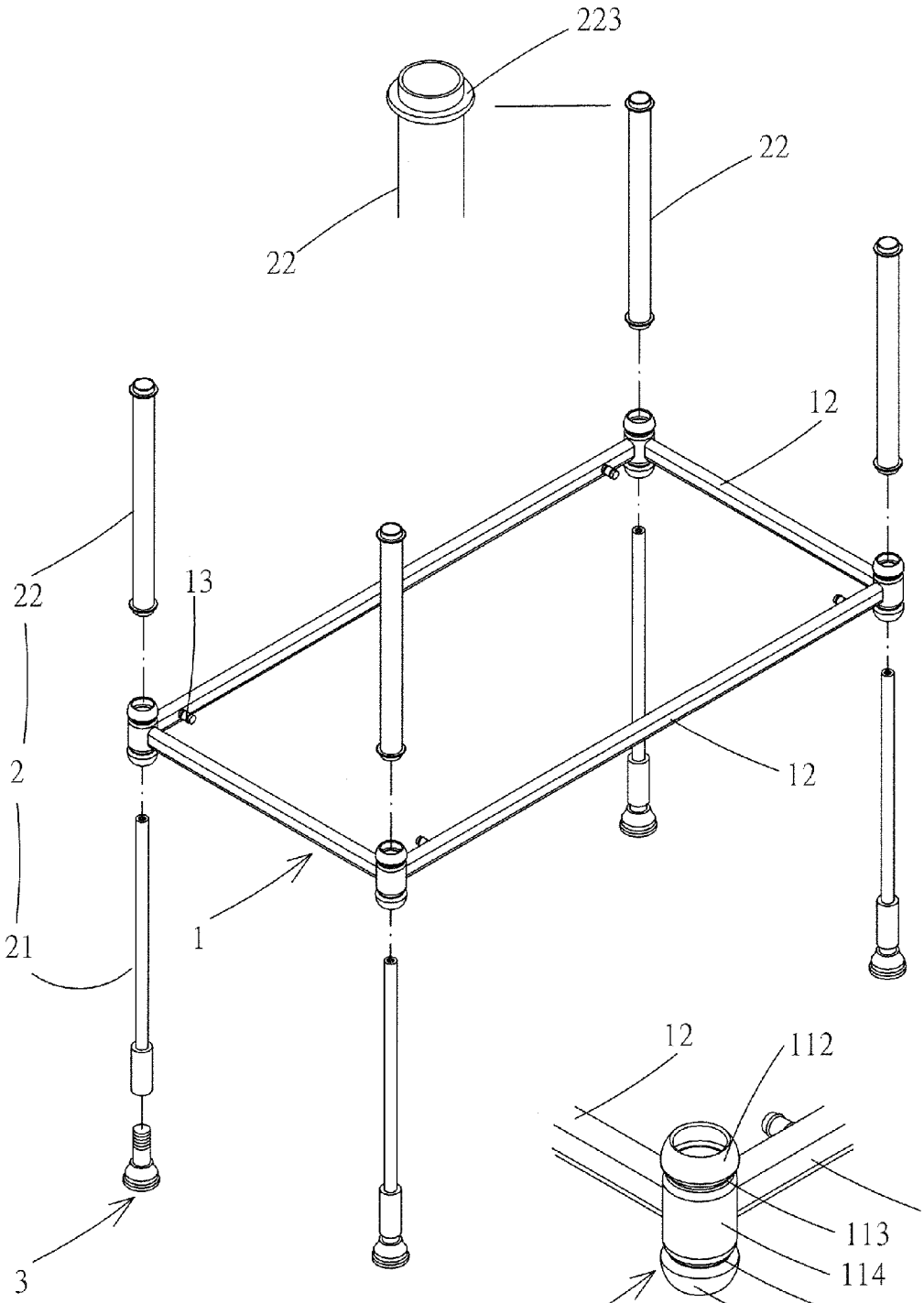
FIG. 1 is an exploded view of an assembly of a bottommost floor of storage floors, inner tubes and outer tubes in accordance with an embodiment of the present invention.
Figure 1A:
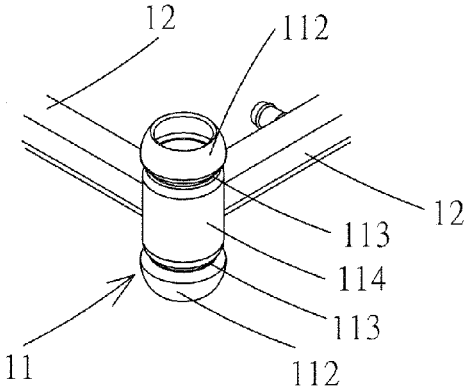
FIG. 1A is an enlarged view of an assembly of a coupling head and a coupling tube in accordance with the present invention.
Figure 2:
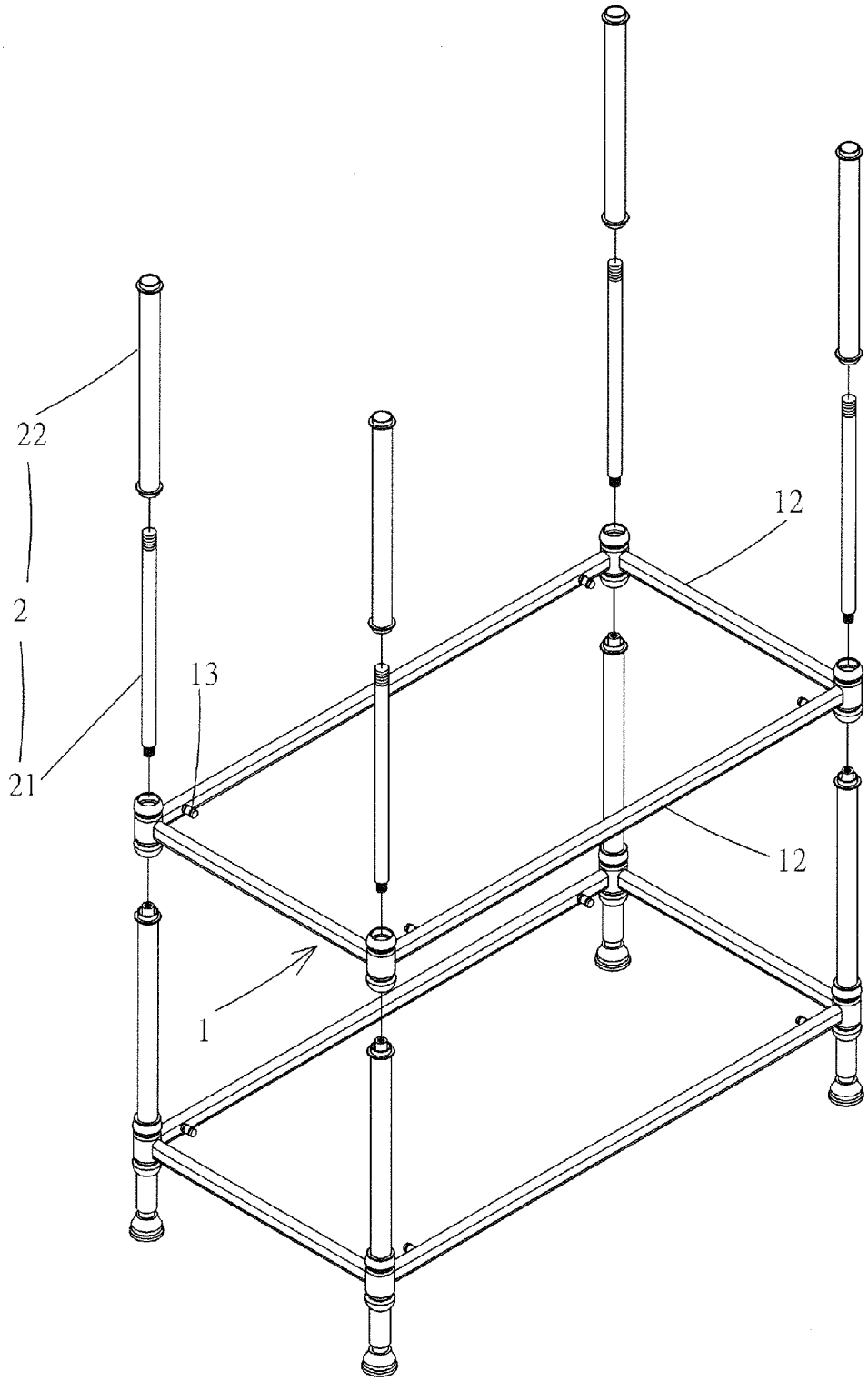
FIG. 2 is an exploded view of an assembly of a second floor of storage floors, inner tubes and outer tubes based on the assembly of FIG. 1.
Figure 3:
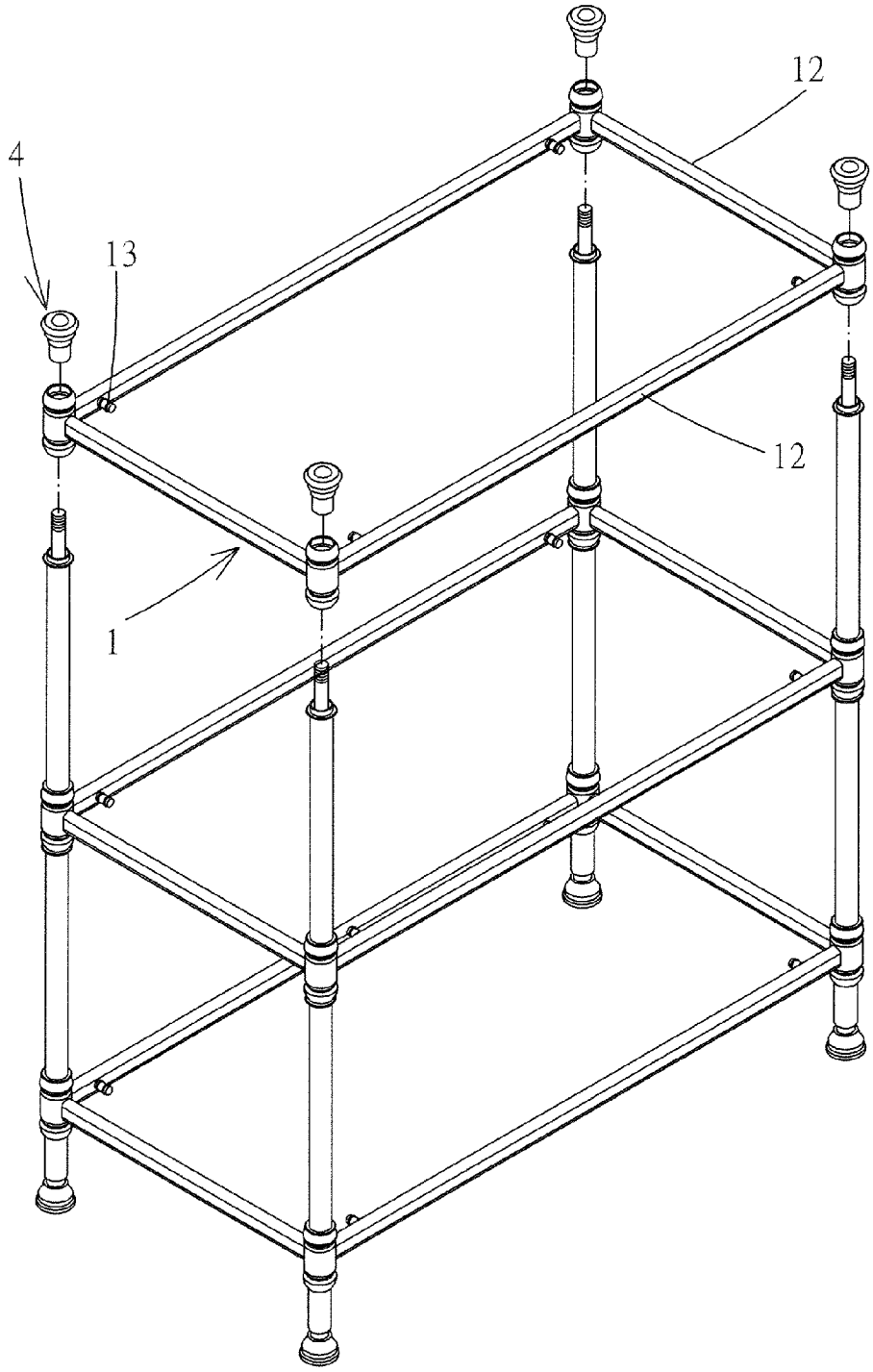
FIG. 3 is an exploded view of an assembly of a third floor of storage floors, inner tubes, outer tubes and decoration elements based on the assembly of FIG. 2.
Figure 4:
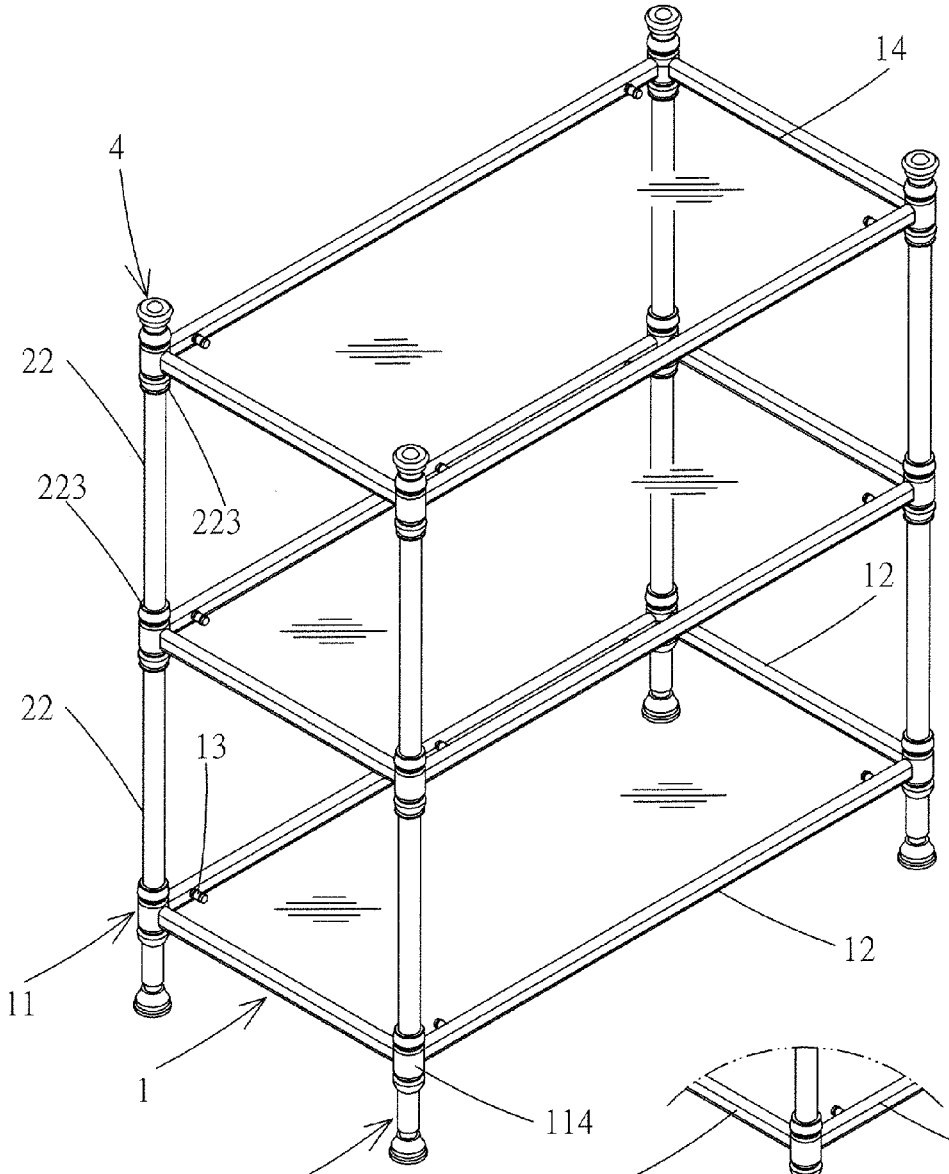
FIG. 4 is a perspective view of the assembly of FIG. 3 and illustrates supporting elements have functions of adjusting a height and moving around
Figure 4A:
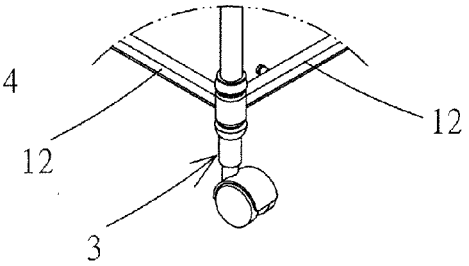
FIG. 4A is an enlarged view of an assembly of the coupling tube and the supporting elements in accordance with the present invention.

While certain embodiments are depicted in the drawings, one skilled in the art will appreciate that the embodiments depicted are illustrative and that variations of those shown, as well as other embodiments described herein, may be envisioned and practiced within the scope of the present disclosure.

DETAILED DESCRIPTION OF THE INVENTION

Illustrative embodiments are now described. Other embodiments may be used in addition or instead. Details that may be apparent or unnecessary may be omitted to save space or for a more effective presentation. Conversely, some embodiments may be practiced without all of the details that are disclosed.

Referring to FIGS. 1-4, in accordance with an embodiment of the present invention, a modular storage frame includes at least two storage floors 1, at least four joining tubes 2, four supporting elements 3 and four decoration elements 4.

Each of the storage floors 1 has four coupling heads 11, four coupling tubes 12 coupled respectively with the coupling heads 11 so as to form an enclosed area, at least four opposing elements 13 protruding respectively from the coupling tubes 12 to the enclosed area, and a storage board 14 arranged within the enclosed area and supported by the opposing elements 13. The coupling head 11 of the storage floor 1 has two coupling portions 112 at top and bottom sides thereof, two neck portions 113 with cavities engaged with the coupling portions 112 and a joining portion 114 coupled between the neck portions 113. The storage board 14 may be glass and shaped like a sheet.

The four joining tubes 2 have four inner tubes 21 passing through the coupling heads 11 respectively for positioning and four outer tubes 22 coupling respectively with top sides of the coupling heads 11 and having an end of the inner tubes 21 protrude therefrom. The outer tube 22 of the joining tube 2 has two positioning elements 223 protruding to an outside thereof and contacting the coupling portions 112 of the coupling heads 11.

The supporting elements 3 couple respectively with the bottommost ones of the inner tubes 21. The supporting elements 3 may provide a function for adjusting a height and/or moving around.

The decoration elements 4 couple respectively with the topmost ones of the inner tubes 21 and couple respectively with the topmost ones of the coupling heads 11.

Figure 5:
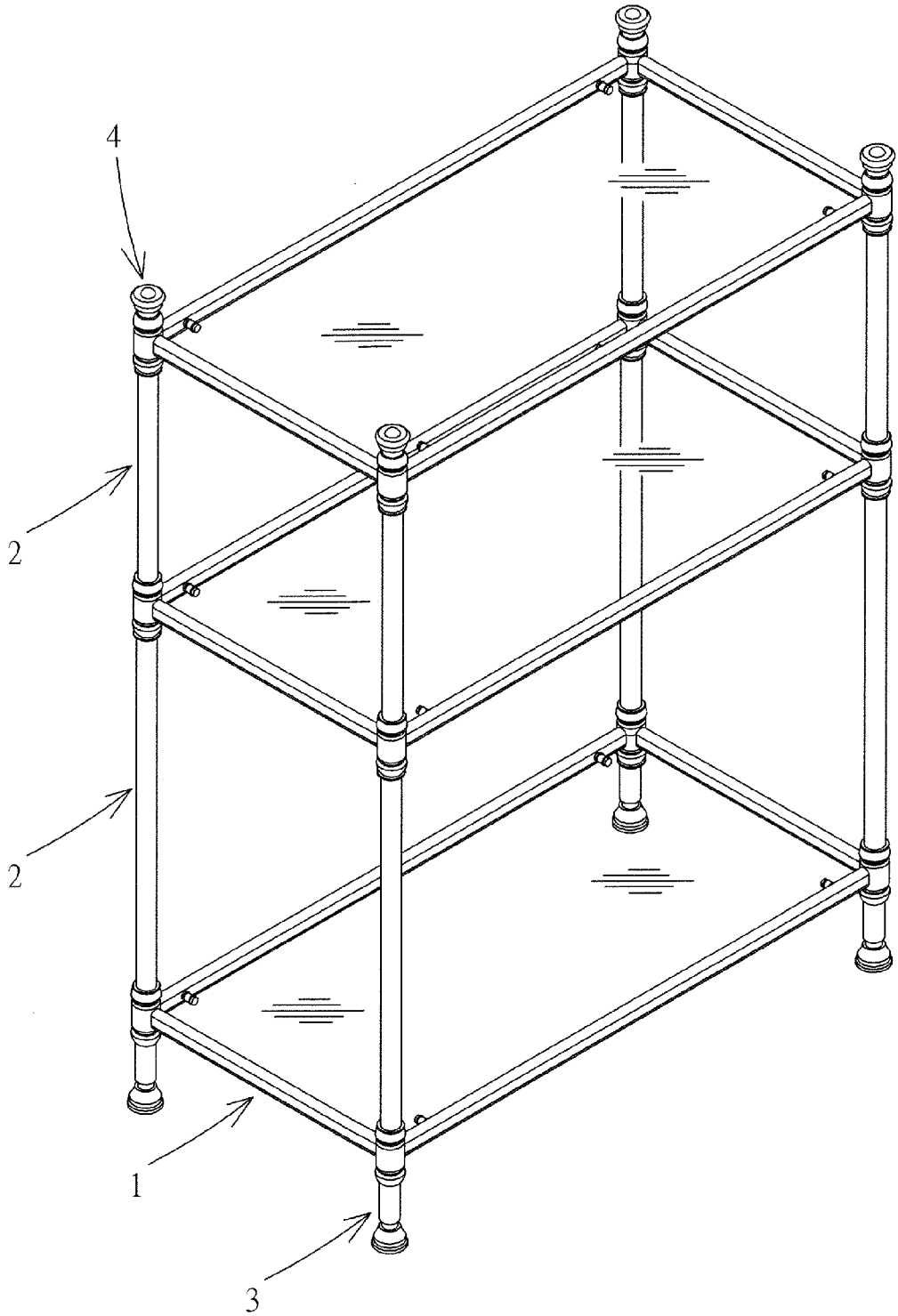
FIG. 5 is a perspective view of the assembly of FIG. 4 in accordance with another embodiment.

Referring to FIG. 5, in accordance with another embodiment, a modular storage frame includes at least two storage floors 1, at least four joining tubes 2, four supporting elements 3 and four decoration elements 4.

Referring to FIGS. 1-5, in accordance with the present invention, the positioning elements 223 at the outside of the joining tubes 2 may provide the storage floors 1 to be relatively firmly positioned. The opposing elements 13 protruding from the coupling tubes 12 may have the storage board 14 to be easily placed and the plight that the opposing elements 13 are not easily assembled with the coupling heads 11 may be avoided.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain. Furthermore, unless stated otherwise, the numerical ranges provided are intended to be inclusive of the stated lower and upper values. Moreover, unless stated otherwise, all material selections and numerical values are representative of preferred embodiments and other ranges and/or materials may be used.

The scope of protection is limited solely by the claims, and such scope is intended and should be interpreted to be as broad as is consistent with the ordinary meaning of the language that is used in the claims when interpreted in light of this specification and the prosecution history that follows, and to encompass all structural and functional equivalents thereof.

What is claimed is:

1. A modular storage frame comprising:

at least two storage floors each having four coupling heads, four coupling tubes coupled respectively with the coupling heads so as to form an enclosed area, at least four opposing elements protruding respectively from the coupling tubes to the enclosed area, and a storage board arranged within the enclosed area and supported by the opposing elements, wherein the coupling head has two coupling portions at top and bottom sides thereof, two neck portions with cavities engaged with the coupling portions and a joining portion coupled between the neck portions; and at least four joining tubes having four inner tubes passing through the coupling heads respectively for positioning and four outer tubes coupling respectively with top sides of the coupling heads and having an end of the inner tubes protrude therefrom, wherein the outer tube has two positioning elements protruding to an outside thereof and each comprising horizontal surface in contact engagement with the coupling portions of the coupling heads to support or to be supported by the coupling portions of the coupling heads.

2. The modular storage frame of claim 1 further comprising four supporting elements coupling respectively with the bottommost ones of the inner tubes.

3. The modular storage frame of claim 2 further comprising four decoration elements coupling respectively with the topmost ones of the inner tubes and coupling respectively with the topmost ones of the coupling heads.

4. The modular storage frame of claim 3, wherein the supporting elements provide a function for adjusting a height.

5. The modular storage frame of claim 3, wherein the supporting elements provide a function for moving around.

6. The modular storage frame of claim 3, wherein the supporting elements provide a function for adjusting a height and/or moving around.

7. The modular storage frame of claim 4, wherein the storage board comprises glass.

8. The modular storage frame of claim 4, wherein the storage board is shaped like a sheet.

9. The modular storage frame of claim 5, wherein the storage board comprises glass.

10. The modular storage frame of claim 5, wherein the storage board is shaped like a sheet.

11. The modular storage frame of claim 6, wherein the storage board comprises glass.

12. The modular storage frame of claim 6, wherein the storage board is shaped like a sheet.

* * * * *